US007168938B2

(12) United States Patent
Wu

(10) Patent No.: US 7,168,938 B2
(45) Date of Patent: Jan. 30, 2007

(54) NYLON GRIPPER ELEMENTS OF ZIPPERS AND THREADED RODS FOR SHAPING THE NYLON GRIPPER ELEMENTS

(76) Inventor: Hsin-Kun Wu, 235 Chung-Ho Box 8-24, Taipei (TW)

( * ) Notice: Subject to any disclaimer, the term of this patent is extended or adjusted under 35 U.S.C. 154(b) by 77 days.

(21) Appl. No.: 10/634,675

(22) Filed: Aug. 6, 2003

(65) Prior Publication Data

US 2004/0025307 A1 Feb. 12, 2004

(30) Foreign Application Priority Data

Jul. 10, 2002 (TW) ..... 91137083 A

(51) Int. Cl.
*B29C 53/64* (2006.01)

(52) U.S. Cl. ..... 425/321; 425/391; 425/814; 425/DIG. 7

(58) Field of Classification Search ..... 425/193, 425/321, 814, 391, DIG. 7; 29/408–410
See application file for complete search history.

(56) References Cited

U.S. PATENT DOCUMENTS 3,729,800 A * 5/1973 Popovitsch ..... 425/814
4,325,184 A 4/1982 Omori ..... 425/391
4,501,547 A * 2/1985 Mizuhara et al. ..... 425/391
4,599,065 A * 7/1986 Takahashi ..... 425/814
6,302,676 B1 * 10/2001 Kato et al. ..... 425/335

* cited by examiner

*Primary Examiner*—Duane Smith
*Assistant Examiner*—Thu Khanh T. Nguyen

(57) ABSTRACT

A nylon zipper has two fastener structures. Each fastener structure has a plurality of nylon gripper elements. Each nylon gripper element has at least one side including a concave portion. A seaming wire for seaming the zipper to a cross strip is embedded in the concave portion. Thereby when pulling a pull head, the seaming wire will not rubber the cross strip. Moreover, a threaded rod device of a nylon zipper comprises two parallel threaded rods. Each threaded rod has threads. One of the threaded rod has a plurality of tips arranged in recesses between each two threads for forming concave portions and convex portions on nylon gripper elements of the fastener structures of the nylon zipper at the same time.

3 Claims, 6 Drawing Sheets

(SEC:I~I)

(SEC:II~II)

(SEC: III ~ III)

NYLON GRIPPER ELEMENTS OF ZIPPERS AND THREADED RODS FOR SHAPING THE NYLON GRIPPER ELEMENTS

FIELD OF THE INVENTION

The present invention relates to zippers, and particularly to nylon gripper elements of zippers and threaded rods for shaping the nylon gripper elements.

BACKGROUND OF THE INVENTION

In the prior art, the threaded rod device for shaping a nylon zipper is formed by two parallel threaded rods for winding nylon wires into nylon gripper elements. With reference to FIG. 1, a center wire 1 enters into a shaping mold 4 from a center of a clip 3. The nylon wire 2 wound the central wire 1 is guided into the shaping mold from a lateral side. When the wires 1 and 2 have entered into the shaping mold 4, two threaded rods 5 in the shaping mold will clamp the nylon wires into elliptical shape. Then one end of the nylon gripper element is beaten into a nose portion 71 by transversally moving a beating head 6. Thereby, a nylon gripper element is formed.

After forming the nylon gripper element 7, the seaming wire 8 of the zipper is seamed to a cross strip 9, as shown in FIG. 2. The two banks of gripper elements 7 are engaged by the nose portions 71 thereof.

When the seaming wire 8 exposes from the nylon gripper elements 7 and a pull head of the zipper is pulled, the inner wall will rubber the exposed seaming wire 8. Thereby, when the pull head slides, a resisting force generates. Moreover, after long using time, the seaming wire will break. Further, the seaming wire 8 easily slides on the fastener structure, especially, when lateral or twisting force applies upon the seaming wire 8. The seaming wire 8 laterally exposes from the nylon gripper elements. If the zipper is large, the exposing of the seaming wire 8 is more apparent. Since the seaming wire 8 easily slides on the nylon gripper elements, the pull resisting force of the nylon gripper elements for preventing the pull force at two sides of the zipper is low.

SUMMARY OF THE INVENTION

Accordingly, the primary object of the present invention is to provide a nylon zipper having two fastener structures. Each fastener structure has a plurality of nylon gripper elements. Each nylon gripper element has at least one side including a concave portion. A seaming wire for seaming the zipper to a cross strip is embedded in the concave portion. Thereby when pulling a pull head, the seaming wire will not rubber the cross strip.

Another object of the present invention is to provide a threaded rod device of a nylon zipper comprising two parallel threaded rods. Each threaded rod has threads. One of the threaded rods has a plurality of tips arranged in recesses between each two threads for forming concave portions and convex portions on nylon gripper elements of the fastener structures of the nylon zipper at the same time.

The various objects and advantages of the present invention will be more readily understood from the following detailed description when read in conjunction with the appended drawing.

DETAILED DESCRIPTION OF THE PREFERRED EMBODIMENTS

Figure 1:
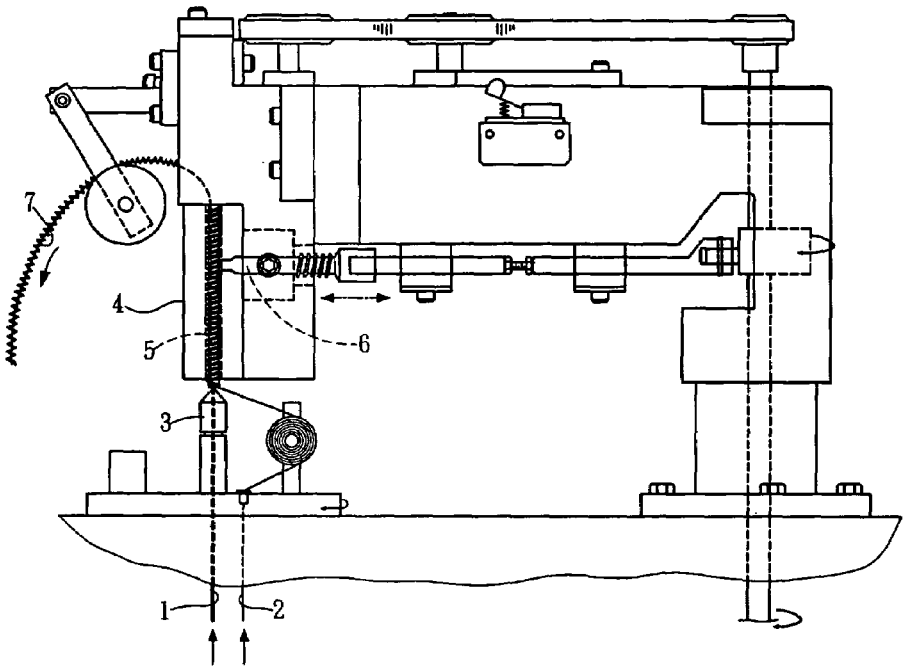
PRIOR ART FIG. 1
FIG. 1 is a schematic view showing the prior art shaping of the nylon zipper by a nylon zipper shaping machine.
Figure 2:
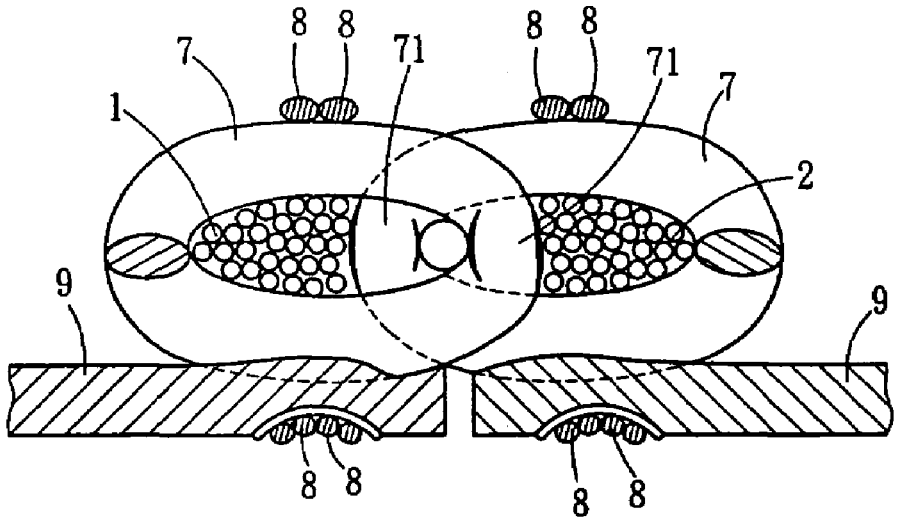
PRIOR ART FIG. 2
FIG. 2 is a cross section view showing that the nylon gripper elements of the prior art nylon zipper is seamed to a cross strip.
Figure 3:
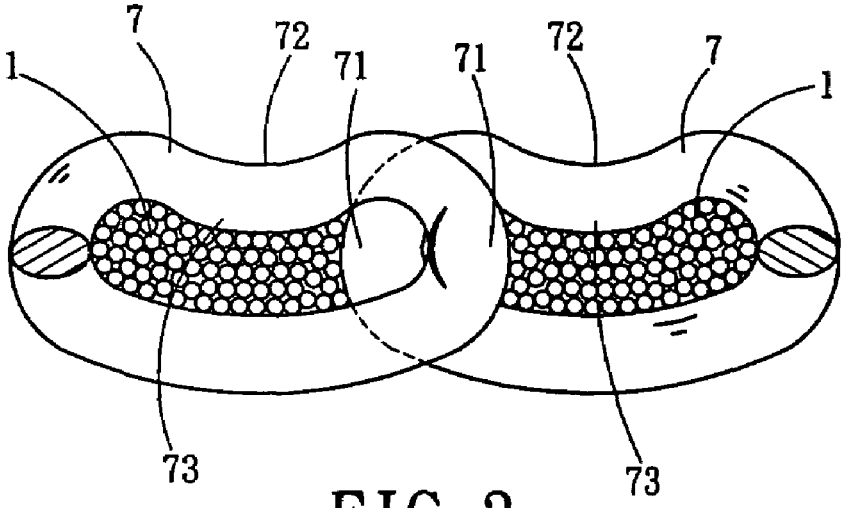
FIG. 3 is a cross section view of the nylon zipper of the present invention.

With reference to FIG. 3, the fastener structure of the nylon zipper of the present invention is illustrated. In the drawing, it is illustrated that each nylon gripper element 7 has a hollow center which is passed by a wire 1. Two nylon gripper elements 7 are engaged by the respective engaging portions 71 thereof. Each nylon gripper element 7 is hollowed at a center thereof. An outer side of each nylon gripper element 7 is formed with a cambered concave portion 72 and an inner side of the nylon gripper element 7 is formed with a convex portion 73 corresponding to the concave portion 72. The convex portion 73 will extrude the wire 1 toward to sides. Thereby, the density of the central wire 1 is higher than the prior art wire. Thus, the wire 1 is well engaged with the nylon gripper elements 7.

Figure 4:
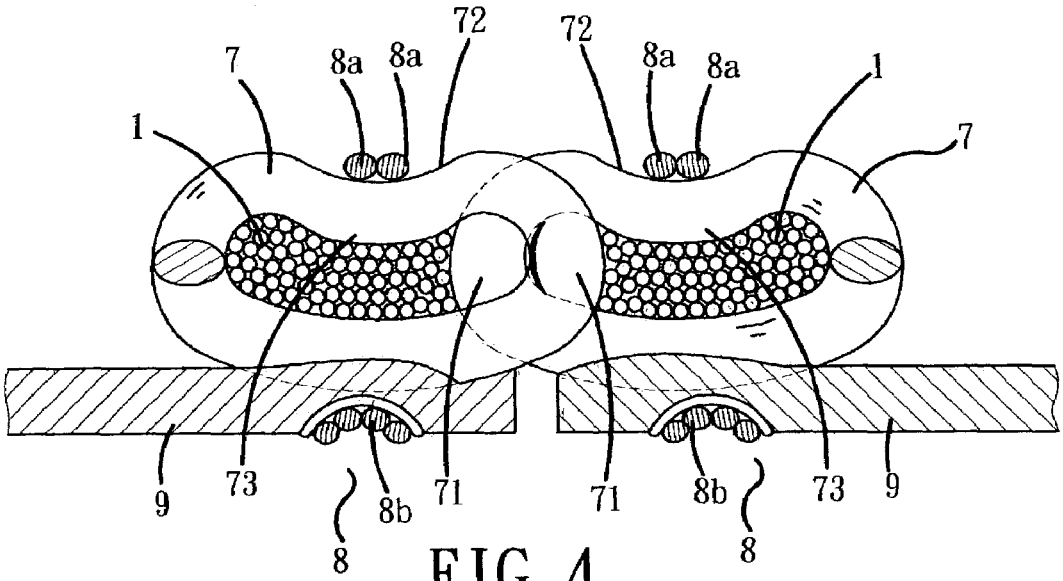
FIG. 4 is a cross section view showing the nylon gripper elements of the nylon zipper of the present invention being seamed to the cross strips.
Figure 5:
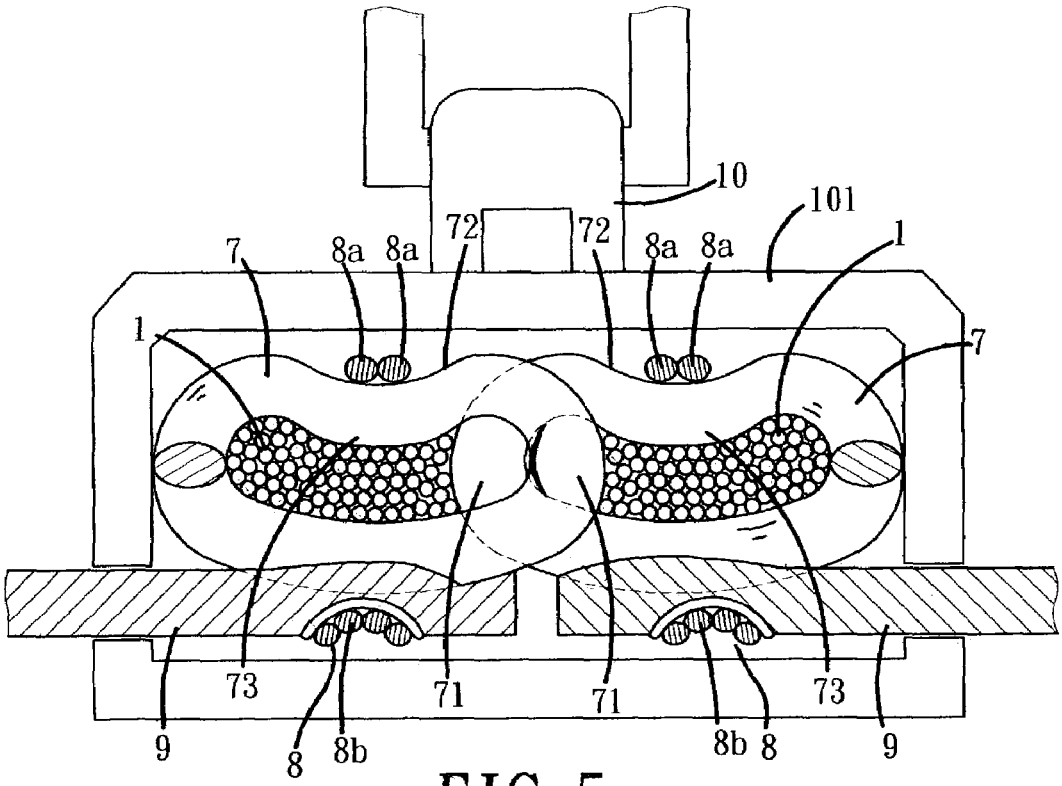
FIG. 5 shows the engagement of the nylon zipper with the pull head according to the present invention.

With reference to FIG. 4, it is illustrated that the, nylon zipper of the present invention is seamed to cross strips 9. Upper seaming wires 8*a* are embedded into the cambered concave portions 72 and lower seaming wires 8*b* are located below the cross strips 9. Thereby, the seaming wires 8 are exposed from the nylon gripper element. As a result, the friction force on the bottom of the pull head 10 is reduced. Thereby, the pull head 10 will not break as used for a long time and thus the lifetime of the zipper is prolonged.

Figure 6:
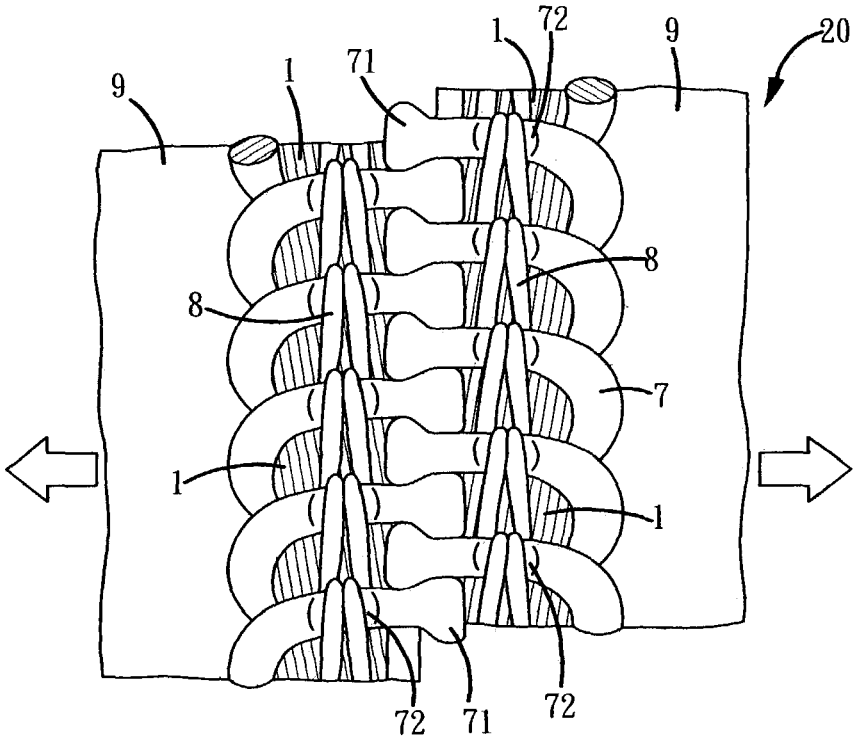
FIG. 6 is an elevational view of the nylon zipper of the present invention.

FIG. 6 shows an elevational view of the nylon zipper of the present invention. Two fastener structures are alternatively engaged. The seaming wires 8 are embedded into the concave portions 72 so that under the application of the lateral pull force (as shown in the arrow) and twisting force, the seaming wire 8 is confined and positioned in the concave portions 72 and thus the nylon gripper elements 7 are fixed to the cross strips 9. The chains will not deform or loose. Thereby, the nylon zipper of the present invention has better tension and twisting tolerance.

Figure 7:
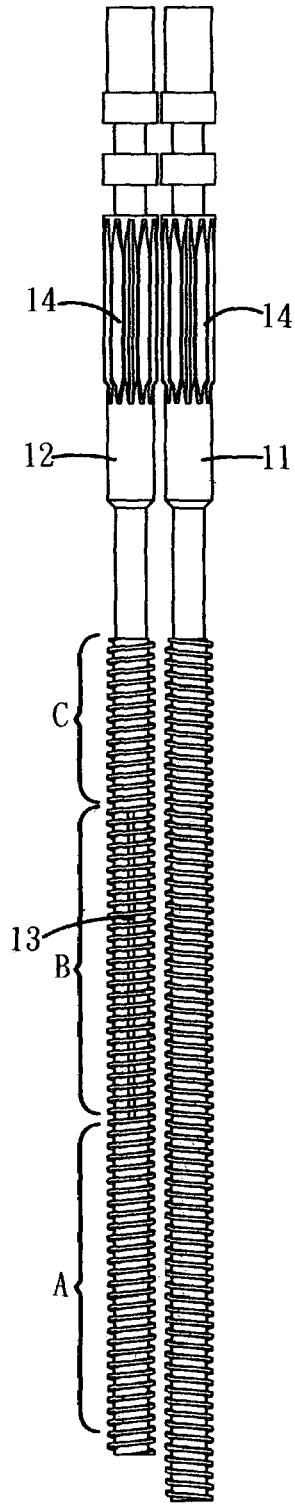
FIG. 7 is a schematic view showing the threaded rods of the present invention.

In the present invention, the shaping threaded rod for forming the nylon gripper elements 7 with concave portions 72 and convex portions 73 of the present invention is illustrated. As shown in FIG. 7, two threaded rods 11, 12 of different lengths are illustrated. One threaded rod has tips 13 on the recesses of the threads thereof. In the embodiment of the present invention, the tips are formed on a short threaded rod 12. This is because that the long threaded rod 11 is suitable for guiding the nylon wires to wind upwards and the short threaded rod 12 is suitable for clamping the nylon gripper elements 7 with the long threaded rod 11. By the clamping force of the cambered tips 13, each nylon gripper element 7 is formed with concave portion 72 and convex portion 73. The tips are formed as a single straight bank arranged on the recesses of the threads of the threaded rod 12 and is in the middle section B of the threaded rod 12. Therefore the lower section A of the threaded rod 12 is suitable for pressing the nylon gripper element 7 to have an elliptical shape. Then the tips 13 in the middle section B will press the nylon gripper element 7 to be formed with concave portions 72 and convex portions 73. Each of the threaded rods 11, 12 is formed with driving nylon gripper element 14 for driving by gears (not shown) so as to rotate the threaded rods 11, 12.

Figure 8:
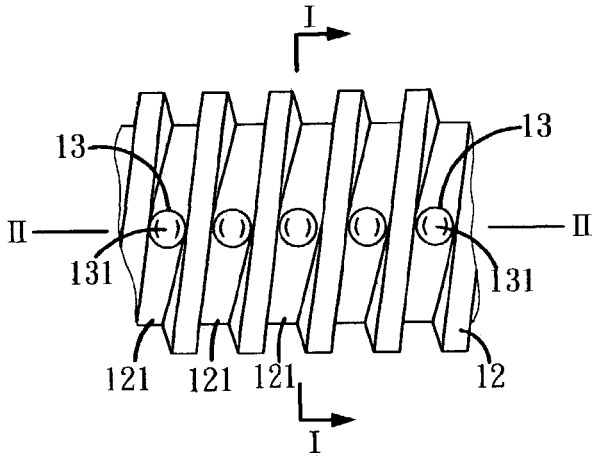
FIG. 8 is a front enlarged view showing the tips being formed on a threaded rod according to the present invention.
Figure 9:
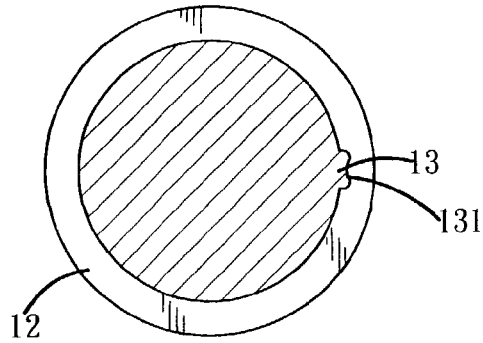
FIG. 9 is a cross section view along line I—I of FIG. 8.
Figure 10:
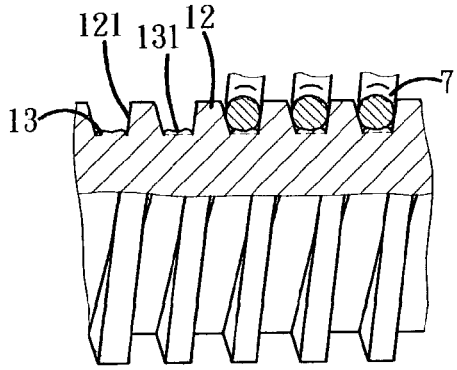
FIG. 10 shows the cross section view along line II—II of FIG. 8.

FIG. 8 is a front enlarged view showing that the tips are on the threaded rod. It is illustrated that the tips 13 are formed as a single bank straight line and are on the recesses 121 of the threaded rod 12. Viewing from the cross section view 1—1 (see FIG. 9), it is found that a top of each tip 13 is a concave slot 131 which causes that the concave portion 72 of the nylon gripper element 7 has a cambered shape without nay sharp edge.

Figure 11:
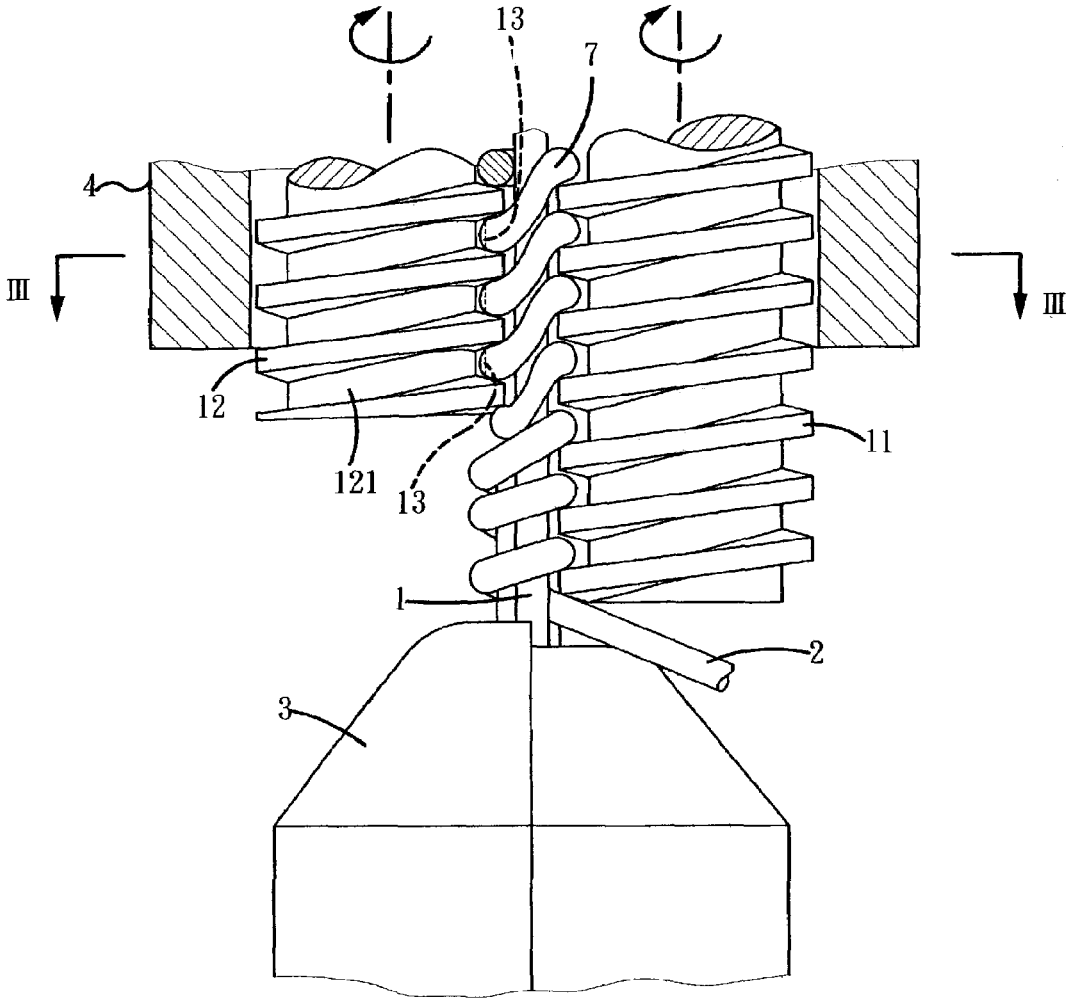
FIG. 11 is a schematic view showing that the threaded rods clamp the nylon zipper according to the present invention.
Figure 12:
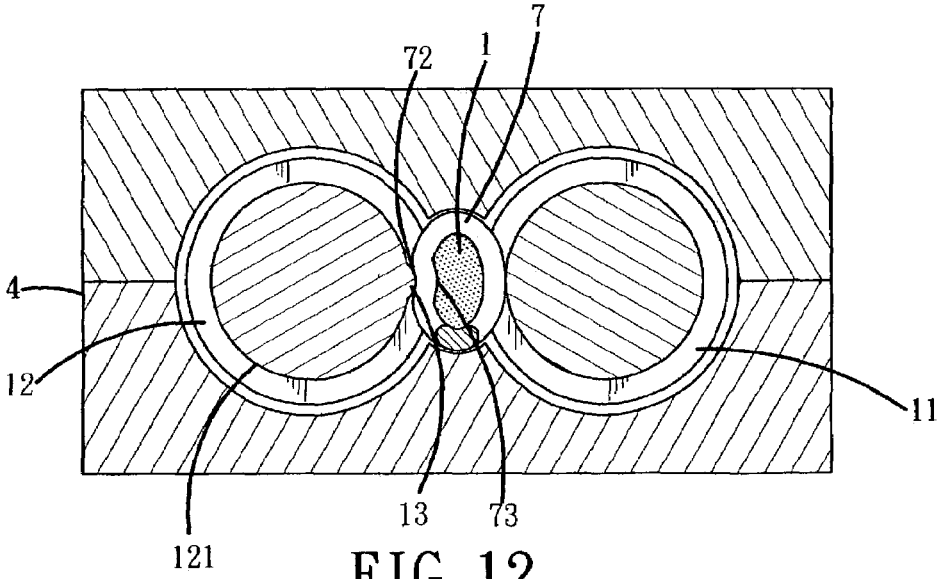
FIG. 12 is a cross section view along line III—III of FIG. 2.

FIG. 11 is a schematic view showing the two threaded rods 11, 12 of the present invention clamping the nylon chains. In the drawing, the nylon wire 2 rises as the central wire 1 and is clamped by the two threaded rods 11, 12 so as to form the nylon gripper elements 7. The threaded rod 12 has tips 13 for forming the concave portions 72 and convex portions 73. This can be seen from the cross section view of FIG. 12. Besides, the tips are at the lower section A of the threaded rod 12, which will not affect the shaping of the concave portions 72 and convex portions 73 of the nylon gripper elements 7. It is preferable that the tips 13 are at the middle section 13 of the threaded rod 12.

The present invention is thus described, it will be obvious that the same may be varied in many ways. For example, the concave portions 72 can be formed at two sides of the nylon gripper elements 7, or each nylon gripper element 7 has only one concave portions 72 but no convex portion 73. Moreover, the shape of the concave portion 72 may be rectangular or the concave portion 72 is shallow. Such variations are not to be regarded as a departure from the spirit and scope of the present invention, and all such modifications as would be obvious to one skilled in the art are intended to be included within the scope of the following claims.

What is claimed is:

1. A threaded rod device of manufacturing a nylon zipper comprising two parallel threaded rods; each threaded rod having threads; one of the threaded rod having a plurality of tips arranged in recesses between each two threads, the tips are formed as a single straight bank on the recesses of the threads of the threaded rod and is in the middle section of the threaded rod.

2. A threaded rod device of manufacturing a nylon zipper as claimed in claim 1, wherein a top of each tip has a concave recess so that the concave portion is a cambered recess without any sharp region.

3. A threaded rod device of manufacturing a nylon zipper as claimed in claim 1, wherein the plurality of cambered tips are straightly arranged at a middle section of the threaded rod.

* * * * *